United States Patent [19]

Sarkisian

[11] 4,288,053

[45] Sep. 8, 1981

[54] ADJUSTABLE SIGN MOUNTING BRACKET

[76] Inventor: Robert Sarkisian, 4276 Stoneleigh Rd., Bloomfield Hills, Mich. 48013

[21] Appl. No.: 50,453

[22] Filed: Jun. 20, 1979

[51] Int. Cl.[3] ..... E04G 3/00

[52] U.S. Cl. ..... 248/218.4; 40/607; 248/226.1; 248/488

[58] Field of Search ..... 248/218.4, 219.3, 219.4, 248/226.1, 226.3, 226.4, 228–230, 473, 488, 490; 40/606, 607, 610, 612

[56] References Cited

U.S. PATENT DOCUMENTS

| | | | |
|---|---|---|---|
| 1,420,268 | 6/1922 | Hodny | 248/488 X |
| 1,764,071 | 6/1930 | Foulke | 248/226.4 X |
| 1,854,478 | 4/1932 | Meyers | 248/230 |
| 3,164,354 | 1/1965 | Murdock | 248/229 X |
| 3,620,496 | 11/1971 | Bolt et al. | 248/488 X |

FOREIGN PATENT DOCUMENTS

| | | | |
|---|---|---|---|
| 1286852 | 1/1962 | France | 40/607 |
| 72532 | 9/1947 | Norway | 248/230 |

*Primary Examiner*—William E. Lyddane

*Attorney, Agent, or Firm*—Harness, Dickey & Pierce

[57] ABSTRACT

An adjustable bracket for mounting a sign on a pole is disclosed. The bracket has a sign holding means on one side and a securing means on the other. The sign holding means is adapted to hold a wide variety of sizes and shapes of signs, whether placed horizontally, vertically or at an angle relative to the pole. The securing means is self-centering on the pole and securely holds the bracket and sign firmly in place. The securing means grips the sign pole firmly along two lines of force and yet can be tightened and loosened by hand.

2 Claims, 4 Drawing Figures

FIG. 1.
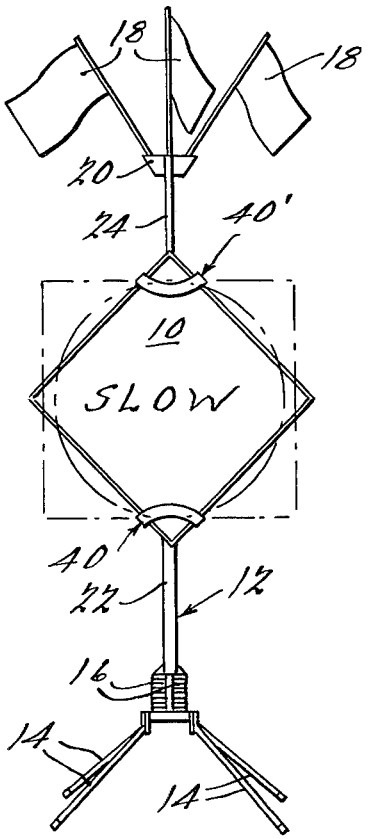
FIG. 2.
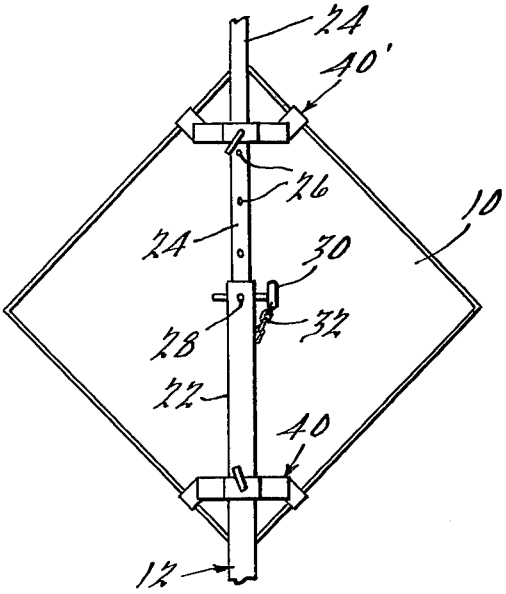
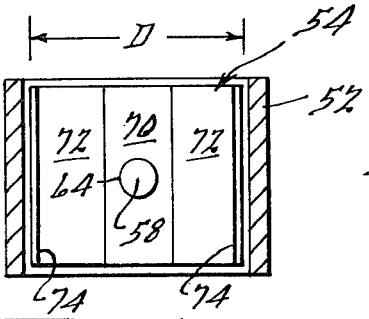
FIG. 4.
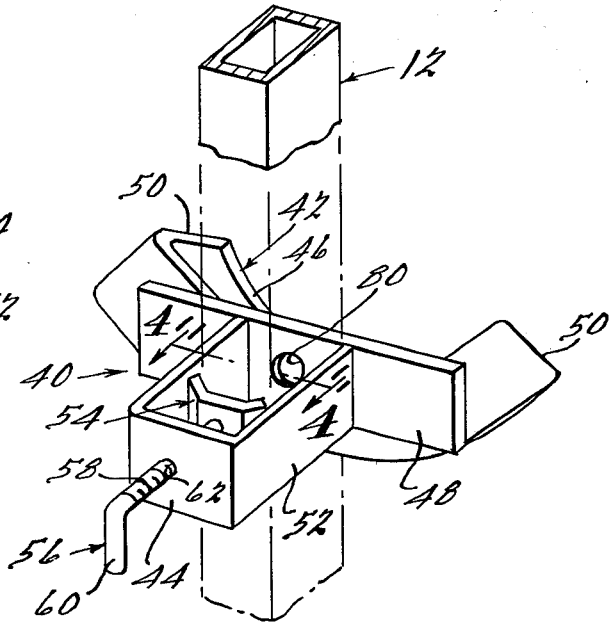
FIG. 3.

ADJUSTABLE SIGN MOUNTING BRACKET

BACKGROUND—SUMMARY OF THE INVENTION

The present invention relates to an adjustable mounting bracket for signs and poster display devices of all kinds. There are numerous sign stands and poster display devices known today which are used for displaying various signs and messages for advertisement and information to the public. Often the signs are large and heavy or are positioned outside requiring relatively strong and durable sign mounting brackets. When adjustable brackets are used where signs of various sizes are displayed on the pole and the signs are changed frequently, the mounting brackets are usually bulky and difficult to position and operate. Also, such brackets require significant forces to tighten and loosen them on the pole, thus necessitating tools.

The present invention is a significant improvement over the aforementioned devices, particularly when used with portable sign stands which are used outdoors and are adaptable to hold and present signs of various sizes, weights and shapes. It is particularly useful for construction-type applications where portable highway and construction related signs are presented for view by passing motorists. Signs used in the construction field are diamond, square, rectangular or circular in shape and the present invention provides brackets for easily mounting and securing in a quick and efficient manner. Construction signs also are made of different types of material, such as metal or wood, have to be strong enough to withstand high winds and other adverse environmental conditions, and have to be large enough to be viewed by motorists at great distances. The sign poles or stands used today have various cross-sectional sizes and shapes and are often telescopic in nature presently different sizes at different points. The present invention is adaptable to function in all of these areas.

It is an object of the present invention to provide an improved mounting bracket for holding and securing signs on a pole. It is a further object to provide an improved adjustable sign mounting bracket which meets the requirements stated above and overcomes all of the problems heretofore known with existing adjustable signs. It is still a further object to provide a sign mounting bracket which is easily adjustable by hand (i.e. without tools), can be used on poles with various cross-sectional sizes and shapes, and will securely hold signs of different sizes, shapes and weights.

In accordance with the invention, an adjustable sign mounting bracket is disclosed which has a sign holding mechanism on one side and a pole securing or gripping mechanism on the other side. The holding mechanism comprises a formed section which fits on the viewing face of the sign and around the edge or a corner thereof. The formed section is adapted to mount on and hold signs of any size or shape. The securing mechanism comprises a "U"-shaped bracket. One end of the handle is threaded and is positioned through a mating threaded hole in the U-bracket and attached to the pressure plate. The plate is curved and situated in such a manner that its edges come into contact with the pole when the bracket is tightened. The curved faces of the plate allow the bracket to be automatically centered on the pole, thus eliminating undesirable bending movements and uneven forces on the sign stand. By means of the handle, the pressure plate is adjustable to poles of different sizes and diameters.

Other objects, features and advantages of the present invention will become apparent from a review of the following description and claims when taken in connection with the accompanying drawings.

BRIEF DESCRIPTION OF THE DRAWINGS

FIG. 1 illustrates a construction sign utilizing the present invention;

FIG. 2 is the rear view of the construction sign shown in FIG. 1;

FIG. 3 is a perspective partial cross-sectional view of the present invention showing how it is mounted on a sign pole; and FIG. 4 is a cross-sectional view taken along lines 4—4 of FIG. 3.

DESCRIPTION OF THE INVENTION

FIGS. 1 and 2 show the inventive mounting bracket in use on a construction sign. The construction sign 10 is mounted on an upright sign stand or pole 12. The pole is supported on the ground by a plurality of legs 14 and a pair of coil springs 16 which allows the sign 10 and pole 12 to deflect when subjected to wind forces and then return to its normal upright position as shown in FIG. 1. Spring mounted sign stands which can be used for this purpose are disclosed and claimed in U.S. Pat. Nos. 3,646,696 and 3,662,482. It is understood, of course, that the present mounting bracket can be used with any type of sign stand or pole, whether permanently anchored or portable, and whether spring mounted or rigidly mounted. At the top of the pole 12 are a plurality of warning flags 18 held in place by a bracket 20. As is commonly known in the construction industry, the flags 18 are used as a high-level warning for approaching traffic.

As better shown in FIG. 2, the pole 12 is telescopic and consists in this instance of two sections, a larger lower section 22 and a smaller upper section 24. The section 24 is adapted to slide inside of section 22 and has a plurality of holes 26 which mate with corresponding holes 28 in the lower section 22 so that the sections can be raised or lowered relative to one another and held in place at the desired position by a pin 30 which is positioned through mating pairs of holes 26 and 28. The pin 30 is attached to portion 22 of the pole 12 by a chain 32 or other similar means so that the pin 30 will not get lost or misplaced when it is not positioned in the holes.

The pole 12 can be of any conventional material which is sturdy enough to be used for the described purpose, although preferably it is of a hollow metal construction, such as aluminum or steel. At present, hollow tubes made from extruded aluminum material have provided very satisfactory results. The cross-sectional shape of the pole 12 also is preferably square or rectangular, as better shown in FIG. 3, although it is understood that the pole can have any cross-sectional size and shape so long as it can be used as a stand for a construction sign or similar display.

The sign 10 is held in place on the sign stand or pole 12 by a pair of adjustable mounting brackets 40 and 40', one positioned on the top corner of the sign 10 and the other at the bottom corner. Preferably, the two adjustable mounting brackets 40 and 40' are identical so that they can accommodate any size or shape of sign 10 and also position the sign at various distances from the ground. In some instances, it is also possible to provide a permanently mounted bracket at one of the edges or corner and merely provide an adjustable bracket at the other. The brackets 40 and 40' also are adjustable to facilitate being used on sign poles 12 of various cross-sectional sizes and shapes, as described below.

As better shown in FIG. 3, the adjustable mounting brackets 40 and 40' are comprised of a sign holding portion 42 and an adjustable gripping or securing mechanism 44. The sign holding portion 42 comprises a curved frontal piece 46 which is secured to a backing support member 48 by welding or any other conventional means. As shown in the drawings, the frontal piece 46 is bent outwardly from the backing member 48 leaving a space therebetween in which the sign 10 can be positioned. The sides 50 of the sign holding portion 42 are angled in a direction such that planes passing through them would converge in front of the sign. In this manner, the corner or edge of a sign of any shape placed in the sign holding portion 42 would be guided downwardly further into the space, holding it as securely as possible. Also, signs of various thicknesses (for example from 1/16 to ¾ inches), are held securely and tightly in place in the bracket due to the unique shape of the portion 42 with the angled sides 50. The curve of frontal piece 46 also helps hold the signs 10 in place; this is particularly shown in FIG. 1 relative to a diamond-shaped sign in which the corners are placed in the sign holding portions 42 and held securely in position.

In order to hold signs in place, the mounting bracket 40 on the bottom edge of the sign has its curved piece 46 placed in a manner such that it is curved upwardly as shown in FIG. 1 while the bracket 40' on the upper edge is positioned such that the curve of the frontal piece 46 is positioned in the opposite direction. In this manner, it is also possible for the mounting brackets 40 and 40' to hold a square or round sign, as shown in phantom lines in FIG. 1.

The sign securing mechanism 44 of the mounting bracket 40 has a "U-shaped" bracket 52, a bent or curved holding plate 54, and a bent rod 56 having threads at one end 58. The U-shaped bracket 52 is connected to the backing member 48 in any conventional manner, such as by welding. The rod 56 is bent at approximately a right angle providing a handle portion 60 at one end for turning and rotating the rod 56 by hand. The end 58 is threadly positioned in a corresponding threaded hole 62 in the U-bracket 52. The plate 54 is attached to the end of the threaded end 58; the plate is attached in such a manner that it is held by the rod and moves therewith, but does rotate with the rod. As shown in FIG. 3, when the handle 60 is rotated, the threaded end 58 will be displaced relative to the U-bracket 52 and the plate 54 will be displaced correspondingly so that it can be tightened and loosened on a pole 12 positioning the U-shaped bracket 52. In order for the plate 54 to be attached in the desired manner to the rod 56, the outer end of the threaded portion 58 is positioned through a corresponding hole 64 in the center of the plate 54 and then enlarged or peened over in some manner providing a secure but loose fit. A hole 80 is provided in the center of the backing portion 48 of the sign holding portion 42 so that an appropriate tool can be inserted through it and enlarge or peen over the outer end of the handle. The curvature of the frontal portion 46 is such that the hole 80 allows a direct or axial line of access from the front of the sign mounting bracket to the plate 54.

The plate 54 is generally concave in shape, as shown in FIGS. 3 and 4. The plane of the center portion 70 is essentially parallel to the outer end of the U-bracket 52 and thus transverse to the sides of the U-bracket. The sides 72 of the plate 54 are angled so that their outer edge 74 can grip the pole 12 where necessary. Regardless of the cross-sectional size of the pole 12, the plate 54 is designed so that it will grip the pole along two lines of pressure 73 either on the surfaces 72 or along the outer edges 74.

The U-bracket 52 can be of any size and shape, but essentially is provided of such size that it will accommodate most conventional poles and sign stands used today. When the adjustable sign mounting brackets 40 and 40' are installed on a pole 12, the plate 54 is moved by rotating the rod 56 until the plate 54 engages the pole. The pole 12 is forced between the plate 54 and the backing portion 48 of the bracket. The plate 54 is wedged and pressured tightly in place against the pole 12 by rotating the handle 16 by hand until it is tight. If the pole is larger than the width "D" of the plate 54 (FIG. 4), then the outer edges 74 will contact the pole 12 and provide the requisite lines of pressure on it. If the pole is smaller than distance "D", then the two lines of pressure will fall along the angled surfaces 72. The two lines of pressure increase the holding power of the brackets and mean that the mere mechanical pressure achieved by rotating the handle 56 by hand is sufficient to hold the bracket and sign in place, regardless of the size or weight of the sign. With known sign mounting brackets, it is necessary to use a wrench, a pair of plyers, or other tools in order to move, adjust, and secure in place the brackets on a pole. Also, if the diameter or the size of the pole 12 is less than the distance D of the plate 54, the pole 12 will be automatically centered due to the angled surfaces 72 on the plate 54 as well as in the U-bracket 52. This allows the sign to be mounted precisely in the center of the pole and eliminates any undue concentration of forces and weights on either side of the pole which might cause it to tip over or twist. It is also possible to mount the plate 54 in the U-bracket 52 such that the edges 54 are positioned 90° from the position shown in FIGS. 3 and 4. With this embodiment, the invention also provides the two lines of force or pressure which increases the holding power of the mounting bracket, but does not provide the self-centering or self-aligning feature.

The parts of the sign mounting bracket are preferably made of steel, but can be made of any material which is strong enough to withstand the forces construction signs are normally used to in use.

While it is apparent that the preferred embodiments illustrated herein are well calculated to fulfill the objects above stated, it will be appreciated that the present invention is susceptible to modification, variation and change without departing from the scope of the invention, as defined by the following claims.

What is claimed is:

1. A bracket for mounting a sign on a pole, said bracket comprising a first section for fastening said bracket to said pole, said first section comprising a U-shaped bracket positioned around the pole and connected to a backing member, a gripping plate movably disposed inside said U-shaped bracket, and a handle adjustably mounted on said U-shaped bracket and attached to said gripping plate for moving said plate relative to said U-shaped bracket and securely holding said pole therein, said gripping plate being configured to contact and securely grip said pole along two elongated lines of force, and a second section for holding said sign, said second section comprising a generally C-shaped bracket attached to said backing member said backing member having an aperature therein and said C-shaped bracket being curved allowing access through said aperature to allow attachment of said gripping plate to said handle.

2. The invention as set forth in claim 1 wherein said handle is threaded and is threadedly received in a correspondingly threaded hole in said U-bracket.

* * * * *